US007621763B2

(12) United States Patent
Clark et al.

(10) Patent No.: US 7,621,763 B2
(45) Date of Patent: Nov. 24, 2009

(54) CLAMPING APPARATUS FOR CONNECTING GROUND WIRE TO GROUNDING MEMBER

(75) Inventors: Reuben E. Clark, Cary, NC (US); Gary K. Weise, San Juan Capistrano, CA (US)

(73) Assignee: Consolidated Manufacturing International, Inc., Raleigh, NC (US)

( * ) Notice: Subject to any disclaimer, the term of this patent is extended or adjusted under 35 U.S.C. 154(b) by 132 days.

(21) Appl. No.: 11/782,300

(22) Filed: Jul. 24, 2007

(65) Prior Publication Data

US 2008/0020612 A1 Jan. 24, 2008

Related U.S. Application Data

(63) Continuation-in-part of application No. 10/689,465, filed on Oct. 20, 2003, now abandoned.

(60) Provisional application No. 60/424,604, filed on Nov. 7, 2002.

(51) Int. Cl.
*H01R 13/648* (2006.01)

(52) U.S. Cl. ..... 439/100

(58) Field of Classification Search ..... 439/804, 439/814, 100, 777

See application file for complete search history.

(56) References Cited

U.S. PATENT DOCUMENTS 1,899,309 A * 2/1933 Buchanan ..... 439/100
2,116,776 A 5/1938 Bondeson
3,988,052 A 10/1976 Mooney et al.
4,159,859 A 7/1979 Shemtov
4,189,198 A 2/1980 Reichman
4,210,374 A 7/1980 Churla
4,248,490 A * 2/1981 Bachle ..... 439/98
4,806,108 A 2/1989 Meinhardt
5,816,844 A 10/1998 Perera

OTHER PUBLICATIONS

NSI Industries, Inc., Catalog, Feb 1, 2001.
NSI Industries Inc., Catalog, Jun. 1, 2003.

* cited by examiner

*Primary Examiner*—Ross N Gushi
(74) *Attorney, Agent, or Firm*—Alston & Bird LLP

(57) ABSTRACT

A clamping apparatus for electrically connecting a ground wire to a grounding member includes first and second clamping members cooperating along an engagement plane to apply a clamping pressure to the grounding member therebetween. One of the first and second clamping members includes opposing first and second wall members integrally formed therewith and defining an open channel therebetween, the open channel defining a ground wire ingress opening for receiving the ground wire in a direction substantially perpendicular to the engagement plane. One of the wall members defines a threaded hole for receiving a set screw extending toward the other of the wall members, whereby the ground wire laid into the open channel through the ingress opening is secured against the other of the wall members by the set screw along a ground wire axis parallel to the grounding member axis.

25 Claims, 4 Drawing Sheets

CLAMPING APPARATUS FOR CONNECTING GROUND WIRE TO GROUNDING MEMBER

CROSS-REFERENCE TO RELATED APPLICATIONS

This application is a continuation-in-part of U.S. patent application Ser. No. 10/689,465, filed Oct. 20, 2003 now abandoned, which claims priority to U.S. Provisional Patent Application No. 60/424,604, filed on Nov. 7, 2002, the entire contents of which are hereby incorporated by reference.

BACKGROUND OF THE INVENTION

1. Field of the Invention

The present invention is related to the electrical connection and grounding of ground wires, and more particularly to a clamping apparatus for connecting ground wires to a grounding member.

2. Description of Related Art

Grounding clamps have been used to electrically connect electrical devices to a grounding member, such as rebar, pipe, and ground rods, in order to provide a proper ground for the electrical devices, where typically at least a portion of the grounding members are underground. More specifically, the grounding clamp is typically fastened around the grounding member by via an adjustable clamping mechanism. An electrically conductive cable, i.e., a ground wire, is attached to the grounding clamp and also attached to a ground terminal at the electrical device, thereby providing a path for any ground currents from the electrical device through the grounding clamp, down the grounding member, and into the ground where the currents can be safely dissipated.

Many different grounding clamp designs have been disclosed in the prior art. The prior art grounding clamps, however, may be labor intensive to install. The ground wire may be required to be inserted into a hole defined by the body of the clamp, and then secured therein by a set screw or other fastener. Some grounding clamps may even require a two-part installation, wherein the ground wire must first be secured by a set screw in a hole defined by a separate arm or body, wherein the separate arm or body must then be separately attached to the ground clamp by another fastener. In either case, an installer must first pull the ground wire through the hole and then manipulate the clamp so as to be able to secure the ground wire via the set screw, or to secure the separate arm or body to the clamp. These procedures may be cumbersome and/or time consuming since the ground wire may be relatively large in diameter with respect to the hole, whereby the little extra clearance space available within the hole may cause the ground wire to be difficult to maneuver, e.g., bend to the proper angle, within a confined space. The task may be even more cumbersome and/or time consuming when an installer must attach multiple clamps to the same ground wire. In such a case, the ground wire must be pulled through the securing holes associated with the clamps for long distances. For example, when grounding the vertical stud bolts at the bottom of a light pole the wire may need to be pulled through a first hole in a first clamp and then immediately bent to go around a corner to be inserted into another hole in another clamp, and so on.

The use of such labor intensive grounding clamps may result in increased installation costs. Since highly paid electricians are employed for running and attaching the ground wire, it is desirable to minimize labor costs associated with the installation.

Accordingly, there is a need for a clamping apparatus that reduces installation time and facilitates attachment of the ground wire to the grounding member.

SUMMARY OF THE INVENTION

The above and other needs are met by the present invention which, according to one aspect, provides a clamping apparatus adapted to electrically connect a ground wire to a grounding member. A first clamping member defines first and second threaded holes along substantially parallel first and second axes, respectively, and includes a first medial portion therebetween. Each of the first and second threaded holes is configured to receive a screw therethrough in threaded engagement therewith. A second clamping member, discrete with respect to the first clamping member, defines first and second openings having a second medial portion therebetween. The second clamping member is configured to cooperate with the first clamping member such that the first and second threaded holes align with the respective first and second openings along the respective first and second axes, whereby the screws are capable of being advanced through the first and second openings to engage the respective first and second threaded holes so as to secure the second clamping member to the first clamping member and to define a clamping plane extending therebetween. The second medial portion cooperates with the first medial portion to define a grounding member receiving aperture configured to receive and clamp the grounding member therebetween. The grounding member receiving aperture further defines a grounding member axis extending therethrough substantially perpendicularly to the first and second axes. The second clamping member further includes opposing first and second wall members integrally formed therewith and extending therefrom, away from the clamping plane, so as to define an open channel therebetween. The open channel further defines a ground wire axis parallel to the grounding member axis. The first wall member defines a threaded hole configured to receive a set screw in threaded engagement therewith. The threaded hole extends along a third axis through the first wall member and toward the second wall member, wherein the third axis intersects with the first and second axes. The open channel defines a ground wire ingress opening opposing and directed away from the clamping plane, wherein the ground wire ingress opening is configured to receive the ground wire therethrough, in a substantially perpendicular direction to the clamping plane, between the set screw and the second wall member. The set screw is configured to be advanced through the threaded hole toward the second wall member to secure the grounding wire thereagainst such that the ground wire is secured within the open channel and disposed along a ground wire axis parallel to the grounding member axis.

Another aspect of the present invention comprises a clamping apparatus adapted to electrically connect a ground wire to a grounding member. A first clamping member defines first and second threaded holes along substantially parallel first and second axes, respectively, and includes a first medial portion therebetween. Each of the first and second threaded holes is configured to receive a screw therethrough in threaded engagement therewith. A second clamping member, discrete with respect to the first clamping member, defines first and second openings having a second medial portion therebetween. The second clamping member is configured to cooperate with the first clamping member such that the first and second threaded holes align with the respective first and second openings along the respective first and second axes, whereby the screws are capable of being advanced through the first and second openings to engage the respective first and second threaded holes so as to secure the second clamping member to the first clamping member and to define a clamping plane extending therebetween. The second medial portion cooperates with the first medial portion to define a grounding member receiving aperture configured to receive and clamp the grounding member therebetween. The grounding member receiving aperture further defines a grounding member axis extending therethrough substantially perpendicularly to the first and second axes. One of the first and second clamping members further includes a ground wire clamping receptacle integrally formed therewith and disposed opposite one of the first and second openings from the other of the first and second openings. The ground wire clamping receptacle further comprises integral and contiguous opposing first and second wall members defining an open channel therebetween. The open channel further defines a ground wire axis parallel to the grounding member axis. One of the first and second wall members defines a threaded hole configured to receive a set screw in threaded engagement therewith, wherein the threaded hole extends along a third axis through the one of the first and second wall members toward the other of the first and second wall members. The open channel defines a ground wire ingress opening directed nonparallel to the clamping plane, wherein the ground wire ingress opening is configured to receive the ground wire therethrough, in a substantially perpendicular direction to the clamping plane, between the set screw and the other of the first and second wall members. The set screw is configured to be advanced through the threaded hole toward the other of the first and second wall members so as to secure the first grounding wire thereagainst such that the ground wire is secured within the ground wire clamping receptacle and disposed along a ground wire axis parallel to the grounding member axis.

Such aspects of the present invention thus provide an improved clamping apparatus for electrically connecting a ground wire to a grounding member that may, for example, reduce installation time, allow the ground wire to be "laid-in" and secured with respect to the ground clamp at an intermediate point along the ground wire so as to facilitate a less cumbersome installation, and/or allow more than one ground wire to be electrically connected to a grounding member, whereby the several ground wires can be "laid-in" and secured with respect to the ground clamp at an intermediate point along the respective ground wires so as to further facilitate a less cumbersome installation involving mechanical and electrical connections of the several ground wires.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
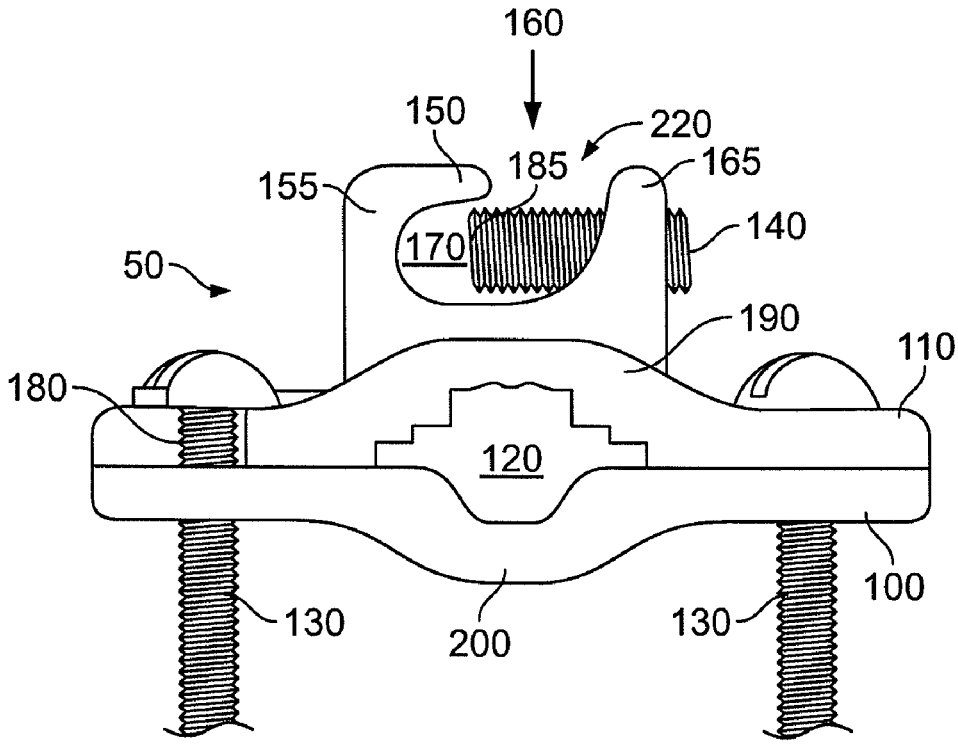
FIG. 1 is a front view illustrating a clamping apparatus according to one aspect of the invention.
Figure 2:
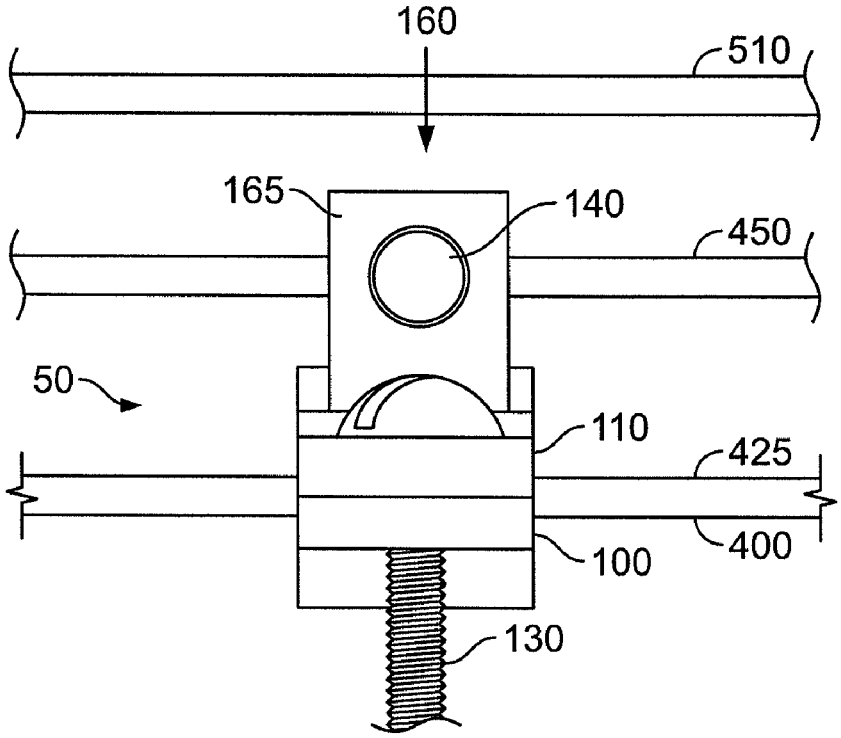
FIG. 2 is a side view illustrating a clamping apparatus according to one aspect of the invention.

FIG. 1 illustrates a clamping apparatus (grounding clamp) 50 used for electrical grounding according to one aspect of the invention. FIG. 2 illustrates a side view of the grounding clamp 50 of FIG. 1. The grounding clamp 50 comprises first and second cooperating clamping members, 100 and 110, respectively (otherwise referred to herein as "bottom" and "top" clamping members, respectively). The first or bottom clamping member 100 defines a threaded hole at opposed distal locations along the length thereof, wherein each threaded hole is configured to threadedly receive respective screws 130 along respective first and second axes, the first and second axes. The second or top clamping member 110 defines respective unthreaded openings at opposed distal locations along the length thereof, in correspondence with the threaded holes of the first clamping member 100, wherein the unthreaded openings are configured to allow the passage of the two screws 130 therethrough. The screws 130 thereby cooperate with the unthreaded openings to extend through the top clamping member 110, and threadedly engaged the threaded holes of the bottom clamp member 100 to secure the clamping members 100, 110 together and form the ground clamp 50. The unthreaded openings defined by the second clamping member 110 may comprise respective apertures. However, in some instances, one of the unthreaded openings of the second clamping member 110 may be configured as a slot 180 extending tangentially to the opposing unthreaded opening. In such instances, the slot 180 may allow the ground clamp to be opened by rotating the one of the clamping members with respect to the other about the opposing screw 130 securing the clamping members 100, 110 together.

Figure 3:
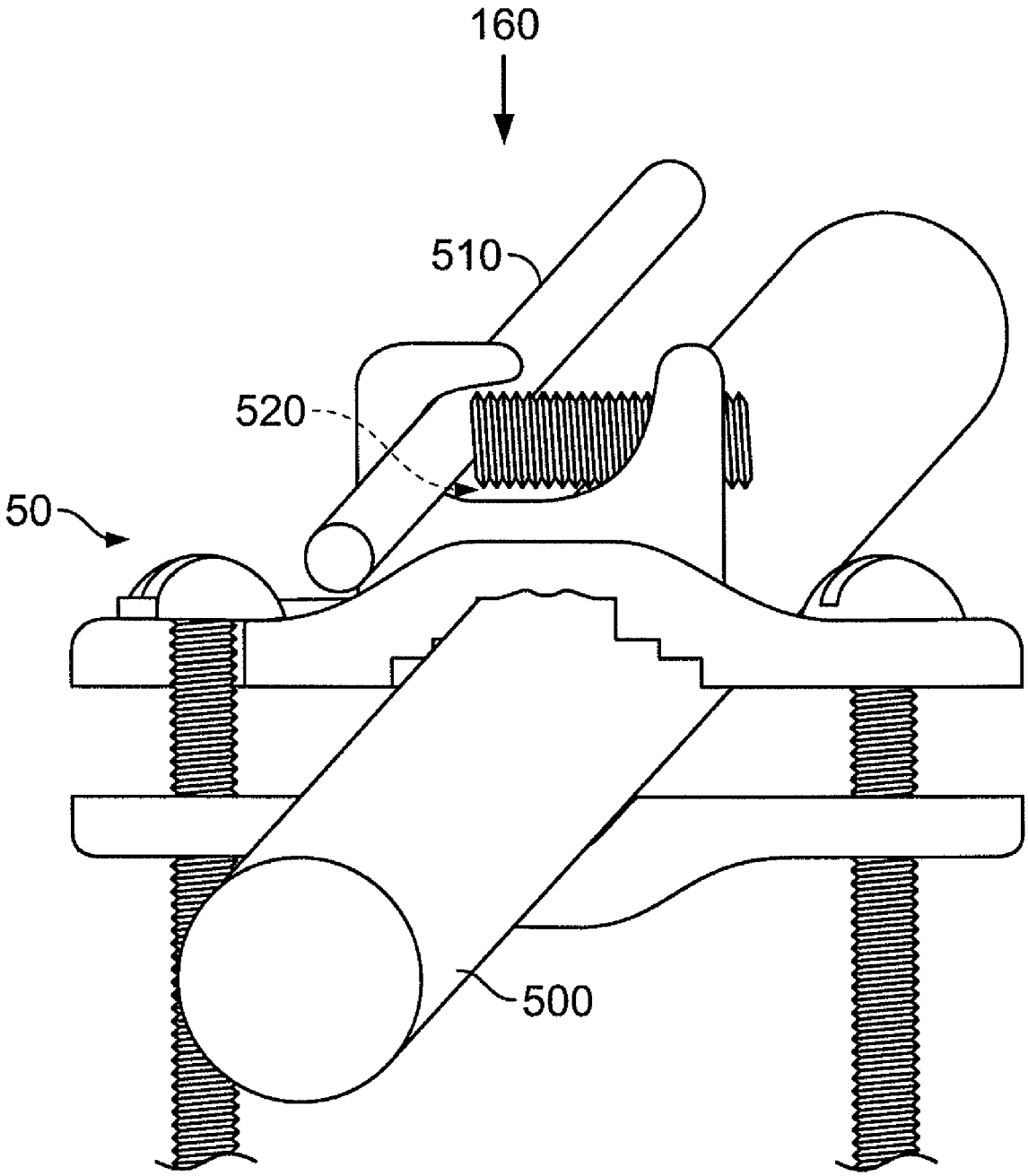
FIG. 3 is a front view illustrating a clamping apparatus in use according to one aspect of the invention.
Figure 4:
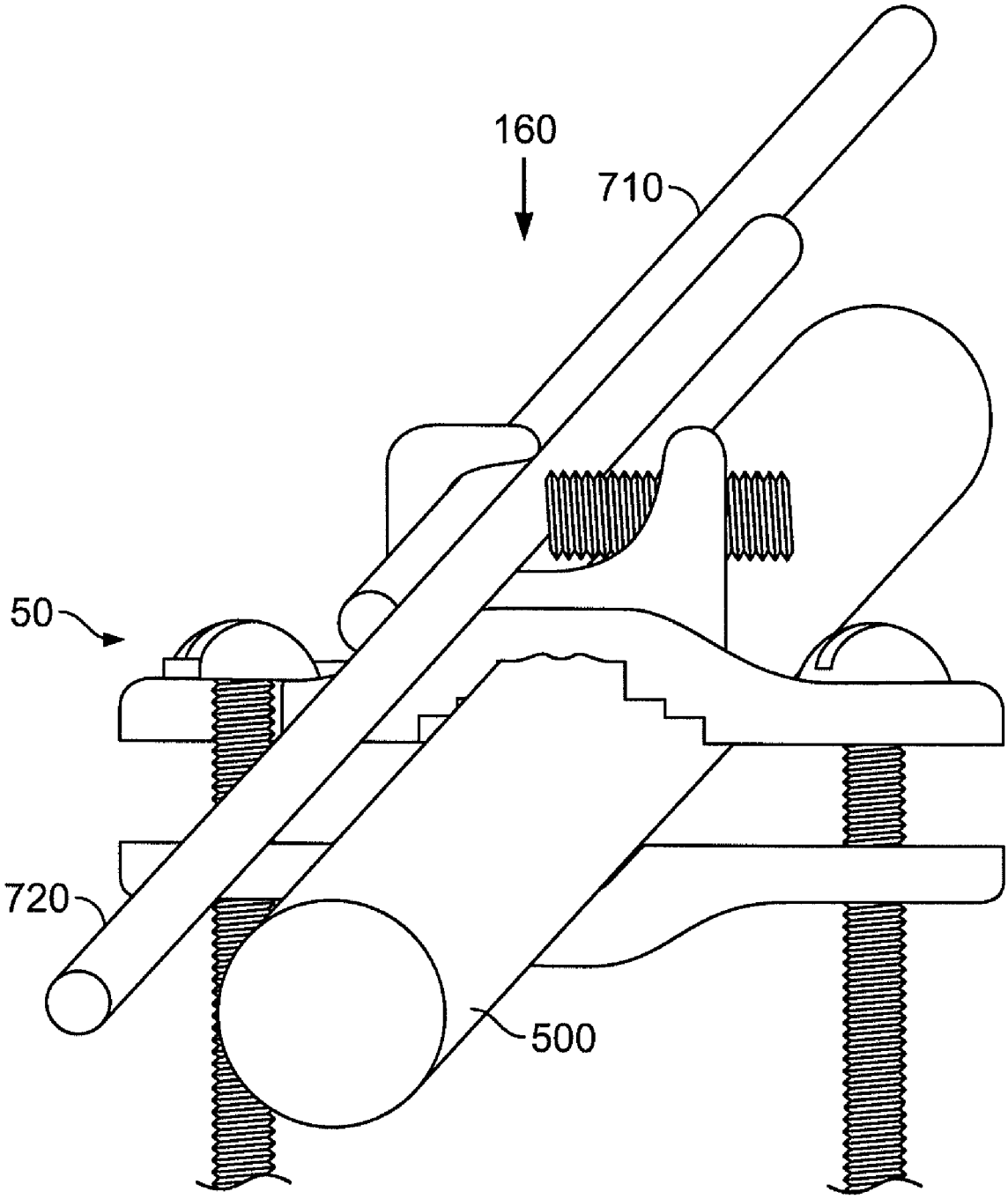
FIG. 4 is a front view illustrating a clamping apparatus accommodating the junction of two ground wires according to one aspect of the invention.

The first clamping member 100 includes a first (or "bottom") medial portion 200 between the threaded holes thereof, while the second clamping member 110 includes a second medial portion 190 between the unthreaded openings thereof. In some instances, at least one of the first and second medial portions 200, 190 may be crowned or crown-shaped. In any instance, with or without crowned medial portions, the first and second clamping members 100, 110 are configured to cooperate, in conjunction with the screws 130, to define a grounding member receiving aperture 120 therebetween for receiving a grounding member 500 therethrough. The grounding member 500 may comprise, for example, a section of rebar, a pipe, a grounding rod, or other appropriate metallic structure, as shown in FIG. 3 or 4, installed so as to be in grounding contact with the earth. In any instance, the first and second clamping members 100, 110 are configured to cooperate to define a clamping plane 400 extending therebetween upon engagement with the grounding member 500, wherein the clamping plane 400 is substantially perpendicular to the first and second axes of the screws 130. Further, the grounding member receiving aperture 120 also defines a grounding member axis 425 extending therethrough, in a coplanar manner with the clamping plane 400 and substantially perpendicular to the first and second axes of the screws 130.

FIG. 1 illustrates that both the top 110 and the bottom 100 clamping members include respective crowned medial portions 190, 200, though one skilled in the art will appreciate that either clamping member, or neither clamping member, may include the crowned medial portion. Further, if both clamping members include crowned medial portions, symmetry therebetween is not essential. In some instances, at least one clamping member having a crowned medial portion may be beneficial for positively defining the grounding member receiving aperture 120 between the clamping members 100, 110, in which the grounding member 500 is to be secured. The screws 130 are tightened and loosened to move the top 110 and bottom 100 members together and apart, respectively, to reduce and enlarge the opening 120 for securing or otherwise allowing installation or de-installation of the grounding member 500 with respect to the grounding member receiving aperture 120. The screws 130 are tightened to apply pressure against the grounding member 500 via the clamping members 100, 110, so as to provide and maintain electrical contact between the ground clamp 50 and grounding member 500. In some instances, the inward-facing surfaces of the top and/or bottom medial portions 190, 200 defining the grounding member receiving aperture 120 may be serrated or otherwise uneven so as to improve electrical contact between the ground clamp 50 and grounding member 500.

In one advantageous aspect, the second or top clamping member 110 may further comprise first and second wall members 165, 155 integrally formed therewith and extending therefrom away from the clamping plane 400 defined by cooperation between the first and second clamping members 100, 110. The first and second wall members 165, 155 further cooperate to define an open channel 170 therebetween for receiving a ground wire 510 therein, with the open channel 170 defining a ground wire axis 450 substantially parallel to the grounding member axis 425. The first wall member 165 defines a threaded hole for receiving a set screw 140 in threaded engagement therewith. The threaded hole, and thus the set screw 140, extends along a third axis through the first wall member 165, toward the second wall member 155. The third axis is substantially perpendicular to the screws 130 securing the clamping members 100, 110 (and the corresponding first and second axes) and, in some instances, the third axis is substantially parallel to the clamping plane 400. In this manner, with the third axis being substantially perpendicular to the screws 130 (first and second axes), or substantially parallel to the clamping plane 400, the grounding clamp 50 presents a "low profile" which may be beneficial or otherwise advantageous in instances of limited mounting depth for the ground clamp 50.

The open channel 170 further defines a ground wire ingress opening 220 configured to receive the ground wire 510 therethrough in a direction 160 substantially perpendicular to the clamping plane 400. As such, the ground wire ingress opening 220 is configured such that the ground wire 510 can be "laid in" from "above" the second or top clamping member 110 in the direction 160 substantially perpendicular to the clamping plane 400. In some instances, the second wall member 155 may further include a retention member 150 integrally formed therewith and extending therefrom toward the first wall member 165, wherein the retention member 150 is configured to cooperate with the first and second walls 165, 155 to retain the "laid-in" ground wire 510 within the open channel 170. Once the ground wire 510 is inserted through the ground wire ingress opening 220, an inwardly-directed end 185 of the set screw 140 cooperates with the second wall member 155 to receive the ground wire 510 therebetween, and to secure the ground wire 510 within the open channel 170 as shown, for example, in FIG. 3. In this manner, the ground wire 510 is secured within the open channel 170 and disposed along the ground wire axis 450 parallel to the grounding member axis 425.

According to one aspect of the invention, the first and second wall members 165, 155 may be disposed between the first and second openings defined by the second or "top" clamping member 110, as shown in FIGS. 1-4. However, in other instances, the second or "top" clamping member 110 may be configured such that the first and second wall members 165, 155 are disposed opposite one of the first and second openings from the other of the first and second openings. That is, in some instances, the first and second wall members 165, 155 may be disposed outwardly of the second medial portion 190 and one of the first and second openings of the second or top clamping member 110.

During installation, the ground clamp 50 is attached to a suitable grounding member 500 as shown in FIG. 3 and as discussed above. The set screw 140 is loosened such that the end 185 is near flush with the inwardly-facing surface of the first wall member 165. The ground wire 510 is then "laid-in" to the open channel 170, via the ground wire ingress opening 220, in the direction 160 which is substantially perpendicular to the clamping plane 400. The ground wire 510 within the open channel 170 is then moved between the set screw 140 and the second wall member 155, wherein the set screw 140 is then tightened (toward the second wall member 155) until the set screw 140 compresses and secures the ground wire 510 between the end 185 of the set screw 140 and the second wall member 155, as shown in FIG. 3. In one instance, the ground wire 510, when secured within the open channel 170, may cause the set screw 140 to extend outwardly of the first wall member 165 in a direction away from the second wall member 155. In such an instance, the set screw 140 may extend over and impede access to the screw 130 disposed adjacent to the first wall member 165 and securing the first and second clamping portions 100, 110 together, whereby the third axis substantially intersects the axis of the screw 130 in a substantially perpendicular manner. As a result, the set screw 140 may beneficially prevent the ground clamp 50 from being inadvertently removed from the grounding member 500 while the ground wire 510 is secured within the open channel 170, by preventing or otherwise impeding access to one of the screws 130 securing the clamping members 100, 110 together.

The set screw 140 is preferably a round point screw, i.e., the end 185 of the set screw 140 is rounded, which may be advantageous in conjunction with, for example, a stranded ground wire, since the rounded end 185 will not tend to sever the wire, or a strand thereof, as compared to a cup point or flat point set screw. In other instances, the a screw-driven sliding wedge (not shown), operably engaged with the first wall member 165 (instead of the set screw 140), may be implemented for applying a securing force to the ground wire 510 against the second wall member 155. FIG. 3 also illustrates that the ground wire 510 may be laid into the open channel 170 at an intermediate portion 520 along the ground wire 510, which may provide labor savings advantages over the prior art grounding methods and apparatuses, as previously discussed. In addition, as shown in FIG. 4, the configuration of the open channel 170 may also facilitate accommodation of more than one (i.e., two) ground wires 710, 720 that are laid into the open channel 170 so as to be disposed "side-by-side" between the set screw 140 and the second wall member 155, whereby both ground wires 710, 720 can then be mechanically (and electrically) connected and secured to the ground clamp 50 via the set screw 140. This added advantage allows the installer to begin a new "wire run" with a new ground wire, when the end of the previous ground wire is reached, without requiring an additional separate device to perform the junction, or the replacement of the ground wire with one long enough to make the entire wire run.

The first ("bottom") and second ("top") clamping members 100, 110 may be comprised, for example, of a metallic or otherwise conductive material, such as any conductive alloy. An appropriate conductive alloy may include, for instance, a copper alloy such as brass or bronze. A ground clamp 50 formed of such a material may be produced, for example, in a casting process (i.e., at least one of the clamping members 100, 110 is cast from a conductive metallic alloy). In addition, the clamping members 100, 110 can, but may not necessarily, be comprised of the same metallic material/alloy. The screws 130 and/or set screw 140 are also comprised of a conductive metallic material, such as various alloys of steel or copper. In one instance, the screws 130 and set screw 140 may be comprised of stainless steel.

According to another aspect of the present invention, at least the second clamping member 110 is comprised of a single strip of a conductive metallic material such as, for example, stainless steel. In order to form at least the second clamping member 110, the single strip may be stamped or otherwise folded to form the various features such as, for example, the crowned medial portion 190 and the first and second wall members 165, 155 defining the open channel 170, whether the first and second wall members 165, 155 are disposed between the first and second openings, or opposite one of the first and second openings from the other of the first and second openings.

Figure 5:
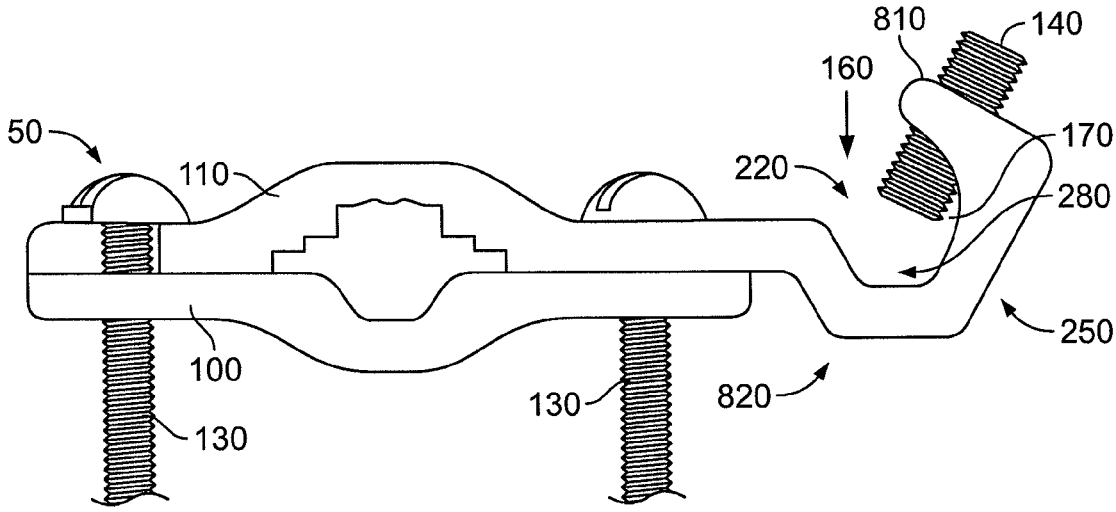
FIG. 5 is a front view illustrating a clamping apparatus according to an alternate aspect of the invention.

FIG. 5 further illustrates an alternate aspect of the present invention wherein at least the second ("top") clamping member 110 is formed of a single strip of a conductive metallic material, such as stainless steel. One skilled in the art will appreciate, though, that the second clamping member 110 may also be cast from a conductive metallic material such as, for example, brass, while retaining the features of this alternate aspect of the invention as disclosed herein. According to such an alternate aspect, the cooperation between the first and second clamping members 100, 110 is the same as previously discussed. As shown in FIG. 5, however, the second clamping member 110 includes a ground wire clamping receptacle 250 integrally formed therewith and disposed opposite one of the first and second openings from the other of the first and second openings. The ground wire clamping receptacle 250 further comprises opposing first and second wall members 810, 820 configured to be integral and contiguous with respect to the second clamping member 110, and defining an open channel 170 therebetween. The open channel 170 also defines a ground wire axis 450 parallel to the grounding member axis 400.

In such an alternate aspect of the invention, the ground wire clamping receptacle 250 may be formed and oriented in different manners such that the ground wire ingress opening 220 is not directed parallel to the clamping plane 400. For example, the ground wire clamping receptacle 250 may be formed such that the third axis is disposed at an angle of about 45 degrees with respect to the clamping plane 400. In this manner, the ground clamp 50 retains a "low profile" mounting structure, while allowing the ground wire 510 to be "laid-in" substantially perpendicularly to the clamping plane 400. Such a configuration also allows the set screw 140 to be readily accessed when lateral mounting space about the ground clamp 50 is limited (i.e., enlarging the mounting space, or providing a special driver device for the set screw 140, may not be required, as with a set screw 140 disposed parallel to the clamping plane 400) since the driver device for the set screw 140 need only be oriented at the angle of the third axis with respect to the clamping plane 400. However, one skilled in the art will appreciate that the third axis may be oriented at many different angles such as, for example, parallel to the clamping plane 400, while retaining the desirable "low profile" mounting structure and "laid-in" configuration for the ground wire 510, as otherwise discussed herein.

In such an embodiment, one of the wall members (shown as the first wall member 810) defines a threaded hole configured to receive the set screw 140 in threaded engagement therewith, wherein the set screw 140 is configured to extend along a third axis toward the other of the wall members (shown as the second wall member 820). As configured, the open channel 170 further defines a ground wire ingress opening 220 that is not parallel (nonparallel) to the clamping plane 400. That is, the ground wire ingress opening 220 is particularly oriented and defined so as to allow the ground wire 510 to be inserted therein in a direction substantially perpendicular to the clamping plane 400 (i.e., "laid-in") such that the ground wire 510 is received between the set screw 140 and the second wall member 820. The set screw 140 is then advanced so as to secure the ground wire 510 within the ground wire clamping receptacle 250 such that the ground wire 510 is disposed along the ground wire axis 450 in parallel relation to the grounding member axis 425.

According to a further aspect, one of the first and second wall members (shown as the second wall member 820) may be angularly folded or stamped so as to define a crease 280, wherein the crease 280 is configured to extend along the ground wire axis 450 so as to receive the ground wire 510 therein. In such an instance, the third axis may be disposed such that the set screw 140 is generally directed toward the crease 280 for securing the ground wire 510 therein against the second wall member 820. One skilled in the art, however, will appreciate that the second wall member 820 may be accurately formed so as to define a concavity (not shown) for receiving the ground wire 510 therein, or in another suitable configuration providing a feature for receiving the ground wire 510, whereby the set screw 140 can then be used to secure the ground wire 510 therein. As shown, due to the configuration of the second wall member 820 as an integral and contiguous element of the second clamping member 110, the ground wire clamping receptacle 250 may extend across the clamping plane 400 of the ground clamp 50, so as to further the "low profile" aspect of the apparatus.

Figure 6:
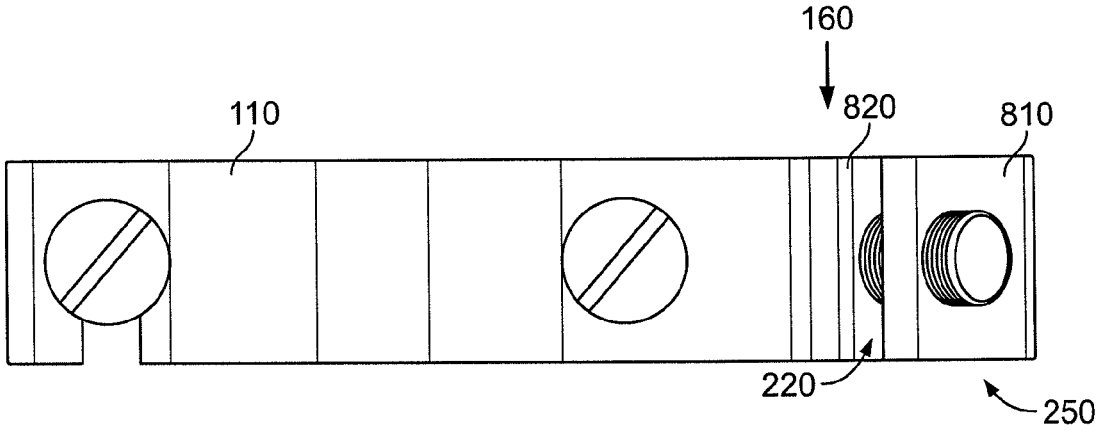
FIG. 6 is a plan view illustrating a clamping apparatus according to an alternate aspect of the invention.

FIG. 6 illustrates a plan view of the second clamping member 110 demonstrating the "laid-in" configuration of the ground wire ingress opening 220. FIG. 6 further illustrates the opposed first and second openings defined by the second clamping member 110 for receiving the screws 130 therethrough, wherein one of the first and second openings may be an aperture, while the other of the first and second openings may be a slot extending tangentially to the aperture.

The ground clamp 50 described herein may thus advantageously allow an installer to lay-in a ground wire 510 with respect to the open channel 170 from a direction substantially perpendicular to the clamping plane 400, thereby facilitating ease of use and considerable labor/time savings, as the installer simply lays out the approximate length of ground wire needed, then lays it into the open channel and secures it with the set screw to complete the grounding installation.

Although the term grounding is used herein in connection with the application of the ground clamp, it should be understood that this term is not limited to grounding applications per se, but generally encompasses similar applications as well, such as, for example, bonding and jumping applications defined by the various electrical codes, such as the National Electrical Code (NEC) and/or various regulatory and testing bodies, such as the National Fire Protection Association (NFPA) and Underwriters Laboratories (UL). Accordingly, the clamping apparatus of the invention is not limited to any one particular application, but is instead intended to be implemented in any number of electrical connectivity-related applications, as will be appreciated by one skilled in the art.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A clamping apparatus adapted to electrically connect a ground wire to a grounding member, comprising:

a first clamping member defining first and second threaded holes along substantially parallel first and second axes, respectively, and having a first medial portion therebetween, each of the first and second threaded holes being configured to receive a screw therethrough in threaded engagement therewith; and a second clamping member discrete with respect to the first clamping member and defining first and second openings having a second medial portion therebetween, the second clamping member being configured to cooperate with the first clamping member such that the first and second threaded holes align with the respective first and second openings along the respective first and second axes, whereby the screws are capable of being advanced through the first and second openings to engage the respective first and second threaded holes so as to secure the second clamping member to the first clamping member and to define a clamping plane extending therebetween, the second medial portion cooperating with the first medial portion to define a grounding member receiving aperture configured to receive and clamp the grounding member therebetween, the grounding member receiving aperture further defining a grounding member axis extending therethrough substantially perpendicularly to the first and second axes, the second clamping member further including opposing first and second wall members integrally formed therewith and extending therefrom, away from the clamping plane, so as to define an open channel therebetweeen, the open channel further defining a ground wire axis parallel to the grounding member axis, the first wall member defining a threaded hole configured to receive a set screw in threaded engagement therewith, the threaded hole extending along a third axis through the first wall member and toward the second wall member, the third axis intersecting with the first and second axes, the open channel defining a ground wire ingress opening opposing and directed away from the clamping plane, the ground wire ingress opening being configured to receive the ground wire therethrough, in a substantially perpendicular direction to the clamping plane, between the set screw and the second wall member, the set screw being configured to be advanced through the threaded hole toward the second wall member to secure the grounding wire thereagainst such that the ground wire is secured within the open channel and disposed along a ground wire axis parallel to the grounding member axis, and the set screw being further configured to extend outwardly of the first wall member, when the ground wire is secured thereby within the open channel, so as to substantially impede access to the screw disposed adjacent to the first wall member and securing the first and second clamping members together.

2. A clamping apparatus according to claim 1, wherein the second clamping member is cast as a monolithic structure of a metallic material.

3. A clamping apparatus according to claim 2, wherein the metallic material comprises brass.

4. A clamping apparatus according to claim 1, wherein the second clamping member is folded from a single strip of a metallic material.

5. A clamping apparatus according to claim 4, wherein the metallic material comprises stainless steel.

6. A clamping apparatus according to claim 1, wherein the first and second wall members are disposed between the first and second openings.

7. A clamping apparatus according to claim 1, wherein the first and second wall members are disposed opposite one of the first and second openings from the other of the first and second openings.

8. A clamping apparatus according to claim 1, wherein the third axis is substantially parallel to the clamping plane.

9. A clamping apparatus according to claim 1, wherein the second wall member further includes a retention member integrally formed therewith and extending therefrom toward the first wall member, the retention member cooperating with the first and second wall members to retain the ground wire within the open channel.

10. A clamping apparatus according to claim 1, wherein at least one of the first and second medial portions is crowned in a direction away from the clamping plane for defining the grounding member receiving aperture.

11. A clamping apparatus according to claim 1, wherein each of the first and second openings comprises an aperture.

12. A clamping apparatus according to claim 1, wherein one of the first and second openings comprises an aperture, and the other of the first and second openings comprises a slot extending tangentially to the aperture.

13. A clamping apparatus adapted to electrically connect a ground wire to a grounding member, comprising:

a first clamping member defining first and second threaded holes along substantially parallel first and second axes, respectively, and having a first medial portion therebetween, each of the first and second threaded holes being configured to receive a screw therethrough in threaded engagement therewith; and a second clamping member discrete with respect to the first clamping member and defining first and second openings having a second medial portion therebetween, the second clamping member being configured to cooperate with the first clamping member such that the first and second threaded holes align with the respective first and second openings along the respective first and second axes, whereby the screws are capable of being advanced through the first and second openings to engage the respective first and second threaded holes so as to secure the second clamping member to the first clamping member and to define a clamping plane extending therebetween, the second medial portion cooperating with the first medial portion to define a grounding member receiving aperture configured to receive and clamp the grounding member therebetween, the grounding member receiving aperture further defining a grounding member axis extending therethrough substantially perpendicularly to the first and second axes, one of the first and second clamping member further including a ground wire clamping receptacle integrally formed therewith and disposed opposite one of the first and second openings from the other of the first and second openings, the ground wire clamping receptacle further comprising integral and contiguous opposing first and second wall members defining an open channel therebetween, the open channel further defining a ground wire axis parallel to the grounding member axis, one of the first and second wall members defining a threaded hole configured to receive a set screw in threaded engagement therewith, the threaded hole extending along a third axis through the one of the first and second wall members toward the other of the first and second wall members, the open channel defining a ground wire ingress opening directed nonparallel to the clamping plane, the ground wire ingress opening being configured to receive the ground wire therethrough, in a substantially perpendicular direction to the clamping plane, between the set screw and the other of the first and second wall members, the set screw being configured to be advanced through the threaded hole toward the other of the first and second wall members so as to secure the first grounding wire thereagainst such that the ground wire is secured within the ground wire clamping receptacle and disposed along a ground wire axis parallel to the grounding member axis.

14. A clamping apparatus according to claim 13, wherein the second clamping member is cast as a monolithic structure of a metallic material.

15. A clamping apparatus according to claim 14, wherein the metallic material comprises brass.

16. A clamping apparatus according to claim 13, wherein the second clamping member is folded from a single strip of a metallic material.

17. A clamping apparatus according to claim 16, wherein the metallic material comprises stainless steel.

18. A clamping apparatus according to claim 13, wherein the third axis is disposed at an angle of about 45 degrees with respect to the clamping plane.

19. A clamping apparatus according to claim 13, wherein the third axis is substantially parallel to the clamping plane.

20. A clamping apparatus according to claim 13, wherein the other of the first and second wall member is at least one of arcuately configured to form a concavity and angularly folded to form a crease, each extending along the ground wire axis.

21. A clamping apparatus according to claim 20, wherein the third axis is directed toward the at least one of the concavity and the crease, whereby the set screw is configured to secure the ground wire therein.

22. A clamping apparatus according to claim 13 wherein the ground wire clamping receptacle extends across the clamping plane.

23. A clamping apparatus according to claim 13, wherein at least one of the first and second medial portions is crowned in a direction away from the clamping plane for defining the grounding member receiving aperture.

24. A clamping apparatus according to claim 13, wherein each of the first and second openings comprises an aperture.

25. A clamping apparatus according to claim 13, wherein one of the first and second openings comprises an aperture, and the other of the first and second openings comprises a slot extending tangentially to the aperture.

* * * * *